US010365036B2

(12) United States Patent
Trout et al.

(10) Patent No.: US 10,365,036 B2
(45) Date of Patent: Jul. 30, 2019

(54) BEVERAGE COOLING DISPLAY SYSTEMS AND METHODS

(71) Applicant: iSee Store Innovations, LLC, St. Louis, MO (US)

(72) Inventors: Chris Trout, St. Louis, MO (US); Mark Schaefer, Town and Country, MO (US); Sesha Madireddi, St. Charles, MO (US)

(73) Assignee: ISEE STORE INNOVATIONS, LLC, St. Louis, MO (US)

( * ) Notice: Subject to any disclaimer, the term of this patent is extended or adjusted under 35 U.S.C. 154(b) by 322 days.

(21) Appl. No.: 14/862,788

(22) Filed: Sep. 23, 2015

(65) Prior Publication Data

US 2017/0082355 A1 Mar. 23, 2017

(51) Int. Cl.
*F25D 31/00* (2006.01)
*F25D 29/00* (2006.01)

(52) U.S. Cl.
CPC ..... *F25D 31/007* (2013.01); *F25D 29/00* (2013.01); *F25D 2331/805* (2013.01); *F25D 2700/10* (2013.01)

(58) Field of Classification Search
CPC ..... F25D 2331/805; F25D 31/007; F25D 2331/803
See application file for complete search history.

(56) References Cited

U.S. PATENT DOCUMENTS 2,655,007 A * 10/1953 Lazar ..... F25C 1/10 165/61
3,316,734 A * 5/1967 Crane, Jr. ..... F25D 3/02 165/80.1
4,078,397 A * 3/1978 Brande ..... F25D 3/08 62/372
4,139,992 A * 2/1979 Fraser ..... A23L 3/364 366/235
4,669,274 A * 6/1987 Huang ..... A23G 9/045 165/89
4,738,113 A * 4/1988 Rudick ..... F25B 21/02 62/3.5
4,813,243 A 3/1989 Woods
5,097,673 A 3/1992 Negishi
(Continued)

FOREIGN PATENT DOCUMENTS

DE 102011079198 A1 1/2013
EP 2006314338 A1 11/2006
(Continued)

OTHER PUBLICATIONS

International Search Report for PCT/US2016/049817 dated Dec. 29, 2016.
(Continued)

*Primary Examiner* — Orlando E Aviles
(74) *Attorney, Agent, or Firm* — Philip S. Hof; The Small Patent Law Group, LLC

(57) ABSTRACT

A beverage cooling display system includes a roller assembly that is configured to rotate one or more beverage containers, and a cooling assembly that is configured to cool the one or more beverage containers. A method of cooling and displaying beverages includes rotating one or more beverage containers with a roller assembly, and cooling the one or more beverage containers with a cooling assembly.

23 Claims, 8 Drawing Sheets

(56) References Cited

U.S. PATENT DOCUMENTS

| | | | | |
|---|---|---|---|---|
| 5,388,427 | A | 2/1995 | Lee | |
| 5,505,054 | A * | 4/1996 | Loibl | A23L 2/42 62/375 |
| 6,363,740 | B1 * | 4/2002 | Hansen | A47F 3/0404 62/236 |
| 6,691,530 | B2 * | 2/2004 | Lee | F25D 3/02 62/378 |
| 7,322,204 | B2 | 1/2008 | Hirao et al. | |
| 8,001,795 | B2 * | 8/2011 | Pfister | F25D 11/02 62/393 |
| 2006/0185372 | A1 * | 8/2006 | Conde Hinojosa | A23L 3/36 62/64 |
| 2014/0053592 | A1 * | 2/2014 | Allard | F25D 25/00 62/441 |
| 2016/0037917 | A1 * | 2/2016 | Li | A47B 73/006 211/74 |

FOREIGN PATENT DOCUMENTS

| | | |
|---|---|---|
| RU | 2110738 | 5/1998 |
| WO | WO 95/07645 | 3/1995 |

OTHER PUBLICATIONS

International Preliminary Report on Patentability for PCT/US2016/049817 dated Mar. 27, 2018.

Extended European Search Report for corresponding EP Application No. 16849325.2-1009 dated Apr. 3, 2019 (7 pages).

* cited by examiner

BEVERAGE COOLING DISPLAY SYSTEMS AND METHODS

FIELD OF THE DISCLOSURE

Embodiments of the present disclosure generally relate to systems and methods for cooling beverages, and, more particularly, to systems and methods for concurrently cooling and displaying beverages, such as at a point of purchase location.

BACKGROUND OF THE DISCLOSURE

Various commercial enterprises offer refreshments for sale. Some of the refreshments, such as soft drinks, alcoholic beverages, and the like, are refrigerated. Often, the refreshments are positioned within a refrigerated compartment having a transparent door (formed of, for example, glass). The transparent door allows a customer to see the types of refreshments that are available for sale. If the customer chooses to purchase a particular soft drink, the customer opens the door, removes a soft drink within the refrigerated compartment, and then closes the door.

Various products are displayed throughout a particular establishment. For example, products may be displayed in aisles, near an entrance to the establishment, at a point of purchase location (such as a check-out counter), and/or the like. In various establishments, cool/cold refreshments may be displayed proximate to a point of purchase location to entice a paying customer to purchase the refreshment before he/she completes payment and leaves the establishment. In order to offer cool refreshments at a point of purchase location, a proprietor may store the refreshments in a refrigerator or cooler. However, a refrigerator may be large and obtrusive, and take up valuable retail space. In contrast, a cooler typically uses ice to cool contents. Melting ice generally needs to be continually changed. Moreover, a cooler often does not provide a customer with a full view of the products therein.

SUMMARY OF THE DISCLOSURE

A need exists for a system and method for concurrently cooling and displaying refreshments. A need exists for a system and method of offering cold beverages in a compact, intriguing, and eye-catching manner. Further, a need exists for effectively cooling and displaying beverages at a point of purchase location.

With those needs in mind, certain embodiments of the present disclosure provide a beverage cooling display system that may include a roller assembly that is configured to rotate one or more beverage containers (each of which contains a liquid beverage), and a cooling assembly that is configured to cool the beverage container(s). The roller assembly may be configured to concurrently rotate the beverage container(s) as the cooling assembly cools the beverage container(s).

The roller assembly may include one or more rollers that are configured to cause the beverage container(s) to rotate. The roller(s) may be operated to rotate the beverage container(s) at variable rates, such as up to two revolutions per minute, for example. In other embodiments, the rotation rates may be greater than two revolutions per minute, such as, for example, six revolutions per minute. Such a rate of rotation effectively chills the liquid beverage contained within the beverage containers, but does not substantially agitate the liquid beverage. The roller assembly may also include a motor coupled to the roller(s). The roller assembly may also include a link that couples the motor to the roller(s). The link may include at least one chain, drive belt, or the like that connects to one or more gears connected to the roller(s).

The cooling assembly may include one or more cold plates. The beverage container(s) are configured to be positioned above the cold plate(s). In at least one embodiment, each cold plate may include an upper cradling surface that conforms to a shape of at least a portion of an outer surface of the beverage container(s). For example, the upper cradling surface may be sized and shaped to conform to a radial portion (for example, a 30° radial portion) of a beverage can. The upper cradling surface may or may not touch the surface of the beverage can. In at least one embodiment, a gap may exist between the beverage can and the upper cradling surface. As the temperature of the cold plate(s) drop below a dew point, condensation collects in the upper cradling surface. The liquid condensate fills the gap between the beverage can and the upper cradling surface, which increases the chilling efficiency.

The beverage cooling display system may also include a temperature sensor coupled to the cold plate(s). The temperature sensor may be configured to detect a temperature of the cold plate(s). A control unit may be in communication with the temperature sensor. The control unit may be configured to operate the cooling assembly based on temperature signals received from the temperature sensor. In at least one embodiment, the control unit selectively activates and deactivates the cooling assembly based on a comparison of the temperature signals received from the temperature sensor and a predetermined desired temperature of the cold plate(s).

The cooling assembly may include a condenser and a compressor, or other cooling systems, such as a thermoelectric (Peltier) system. The condenser and the compressor may be configured to circulate refrigerant through the cold plate(s). The cooling assembly may include one or more condensate collectors that are configured to collect condensate from the cold plate(s) and/or the beverage container(s).

Certain embodiments of the present disclosure provide a method of cooling and displaying beverages. The method may include rotating one or more beverage containers with a roller assembly, and cooling the beverage container(s) with a cooling assembly. The rotating may be concurrent with the cooling. The rotating may include operating one or more rollers to cause the beverage container(s) to rotate. The cooling may include positioning the beverage container(s) above one or more cold plates. The method may also include detecting a temperature of at least a portion of the cooling assembly, and using a control unit to automatically operate the cooling assembly based on temperature signals received from the temperature sensor.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a beverage cooling display system and method that concurrently cools (for example, chills) and displays beverage containers (for example, cans or bottles containing liquid refreshments, such as soft drinks, alcoholic beverages, and the like). The system and method display the cooled beverage containers in an eye-catching, intriguing manner. The system and method may include a roller assembly that rotates the beverage containers, while a cooling assembly cools the beverage containers.

Figure 1:
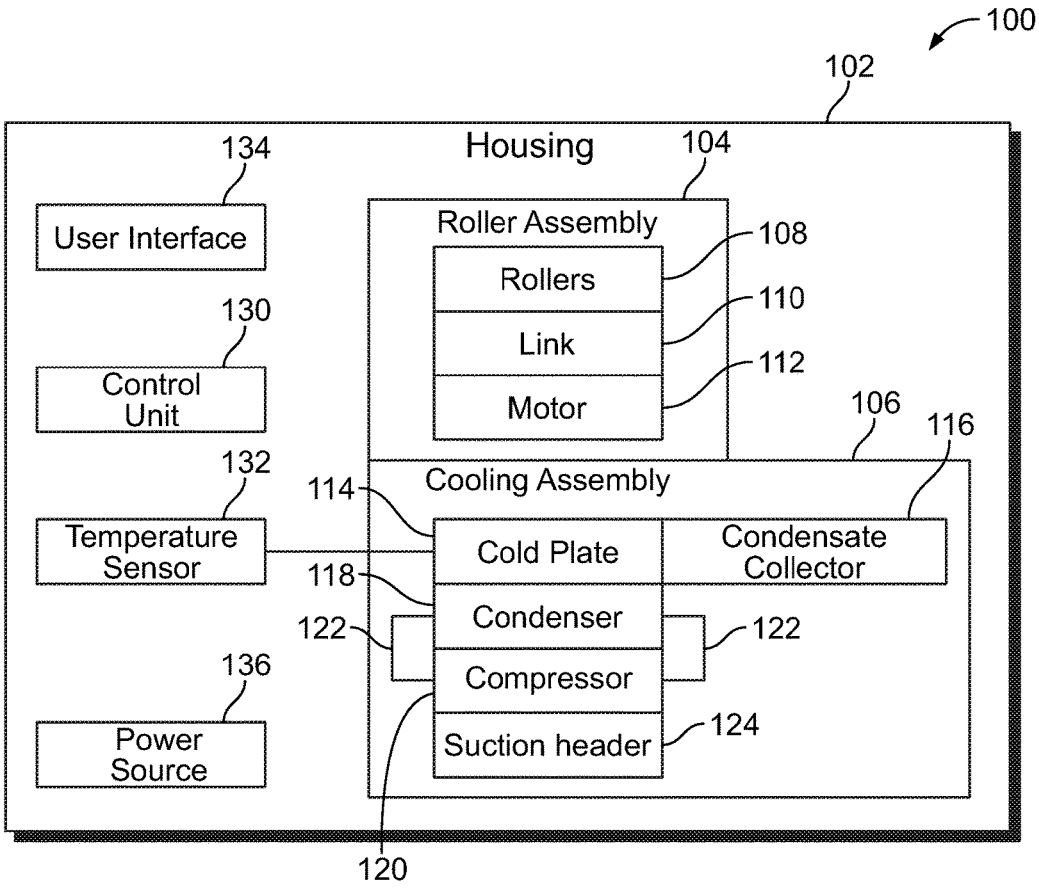
FIG. 1 illustrates a simplified schematic diagram of a beverage cooling display system, according to an embodiment of the present disclosure.

FIG. 1 illustrates a simplified schematic diagram of a beverage cooling display system 100, according to an embodiment of the present disclosure. The beverage cooling display system 100 includes a housing 102 that retains a roller assembly 104 and a cooling assembly 106.

The roller assembly 104 may include one or more rollers 108, a link 110, and a motor 112. The rollers 108 are operatively coupled to the motor 112 through the link 110. The roller assembly 104 may include any number of rollers 108 that are configured to rotate one or more beverage containers, such as cans or bottles. The rollers 108 may include metal (such as aluminum) cylinders that rotatably engage the beverage container(s). The motor 112 may be an electric motor, a piezoelectric motor, a servo motor, another such actuator, and/or the like that is configured to rotate the rollers 108 through the link 110. The link 110 may include gears, chains, sprockets, rotors, and/or the like that operatively couple the motor 112 to the rollers 108. When activated, the motor 112 rotates the rollers 108, which, in turn, rotate the beverage containers.

The cooling assembly 106 may include one or more cold plates 114, one or more condensate collectors 116, a condenser 118 coupled to a compressor 120 and the cold plate 114 through one or more refrigerant conduits 122 (for example, copper tubes, pipes, and/or the like), and a suction header 124. Each cold plate 114 may be adjacent to a roller 108, which may, in turn, be adjacent to a condensate collector 116. The condenser 118, the compressor 120, and the suction header 124 operate to circulate cold refrigerant through the cold plate(s) 114. Each cold plate 114 may be formed of a metal (such as aluminum) and may include a cradling surface that is configured to conform to a size and shape of a at least a portion (such as a half, third, or quarter) of a beverage container. The cradling surface may conform to a shape of an outer surface of a beverage can. In at least one embodiment, the cradling surface may extend around a 15° radial portion of a beverage can. Alternatively, the cradling surface may extend more or less than a 15° radial portion of the beverage can. The cold refrigerant that circulates through the cold plate 114 cools (for example, chills the beverage to a temperature of 35° F.) the beverage container supported over the cold plate 114 and rotated by the roller(s) 108.

Alternatively, the cooling assembly 106 may include various other types of cooling systems. For example, the cooling assembly 106 may include an ice chest, one or more ice packs, one or more heat exchangers, a heat pump, and/or the like.

The housing 102 may also include a control unit 130 that is operatively coupled to the roller assembly 104 and the cooling assembly 106. For example, the control unit 130 may be operatively connected to the motor 112, the condenser 118 and/or the compressor 120 (such as through one or more wired or wireless connections) to control operation of the roller assembly 104 and the cooling assembly 106.

The control unit 130 may also be operatively coupled a temperature sensor 132 that is operatively connected to the cold plate 114. The temperature sensor 132 may be or include one or more of a thermometer, a thermistor, a thermostat, and/or the like that monitors and/or senses a temperature of the cold plate 114. The control unit 130 may selectively activate and deactivate the cooling assembly 106 based on temperature signals received from the temperature sensor 132. For example, the control unit 130 may selectively activate and deactivate the condenser 118 and/or the compressor 120 to maintain a temperature of the cold plate 114 at 32° F.+/−1° F. Alternatively, the control unit 130 may selectively activate and deactivate the condenser 118 and/or the compressor 120 at temperatures that are higher or lower than 32° F.+/−1° F. Also, alternatively, the beverage cooling display system 100 may not include the temperature sensor 132.

The control unit 130 may also be operatively coupled to a user interface 134. The user interface 134 may include one or more switches, buttons, a touch screen display, and/or the like that allows an individual to activate and deactivate the roller assembly 104 and/or the cooling assembly 106. For example, the user interface 134 may include an ON/OFF switch and a digital display that indicates a temperature of the cold plate 114. Alternatively, the beverage cooling display system 100 may not include the user interface 134.

The control unit 130 may also be used to activate a defrost cycle within the system 100 if the cold plates 114 are operated at temperatures below 32° F. For example, in the defrost cycle, the control unit 130 may deactivate a compressor for a time period at certain timed intervals. Optionally, the control unit 130 may activate a defrost cycle based upon input received from one or more sensors that measure the temperature of the cold plate over time. Optionally, the control unit 130 may activate an electric heater coupled to the cold plate, or through reversing hot gas from the compressor.

The housing 102 may also include a power source 136, such as one or more batteries, or an input to a source of electric power (such as a plug that is configured to connect to a wall outlet of alternating current power). The power source 136 provides power for operation of the beverage cooling display system 100.

In operation, an individual may activate the beverage cooling display system 100 through the user interface 134. For example, the individual may switch an ON/OFF switch of the user interface 134 to the ON position. The control unit 130 detects the activation command, and controls the motor 112 to rotate the rollers 108, which rotate beverage containers supported on the cold plate(s) 114 between the rotating rollers 108. The control unit 130 also controls the cooling assembly 106 to cool the cold plate 114. For example, based on a detected temperature of the cold plate 114 (as detected by the temperature sensor 132), the control unit 130 may selectively activate and deactivate the cooling assembly 106 to maintain the cold plate(s) 114 at a desired temperature, such as 32° F.+/−1° F. The desired temperature may be input and stored as data within a memory of (or coupled to) the control unit 130. Accordingly, the beverage cooling display system 100 simultaneously rotates and cools the beverage containers supported on the cold plate(s) 114.

As described above, the control unit 130 may be used to control operation of the beverage cooling display system 100. As used herein, the term "control unit," "unit," "central processing unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the control unit 130 may be or include one or more processors that are configured to control operation of the beverage cooling display system 100.

The control unit 130 is configured to execute a set of instructions that are stored in one or more storage elements (such as one or more memories), in order to process data. For example, the control unit 130 may include or be coupled to one or more memories. The storage elements may also store data or other information as desired or needed. The storage elements may be in the form of an information source or a physical memory element within a processing machine.

The set of instructions may include various commands that instruct the control unit 130 as a processing machine to perform specific operations such as the methods and processes of the various embodiments of the subject matter described herein. The set of instructions may be in the form of a software program. The software may be in various forms such as system software or application software. Further, the software may be in the form of a collection of separate programs, a program subset within a larger program or a portion of a program. The software may also include modular programming in the form of object-oriented programming. The processing of input data by the processing machine may be in response to user commands, or in response to results of previous processing, or in response to a request made by another processing machine.

The diagrams of embodiments herein may illustrate one or more control or processing units, such as the control unit 130. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the control unit 130 may represent processing circuitry such as one or more of a field programmable gate array (FPGA), application specific integrated circuit (ASIC), microprocessor(s), and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

Alternatively, the beverage cooling display system 100 may not include the control unit 130. Instead, when the beverage cooling display system 100 is powered through the power source 136, the rollers 104 and the cooling assembly 106 are activated and continuously operate until the beverage cooling display system 100 is deactivated (such as through a user engaging an OFF switch).

Figure 2:
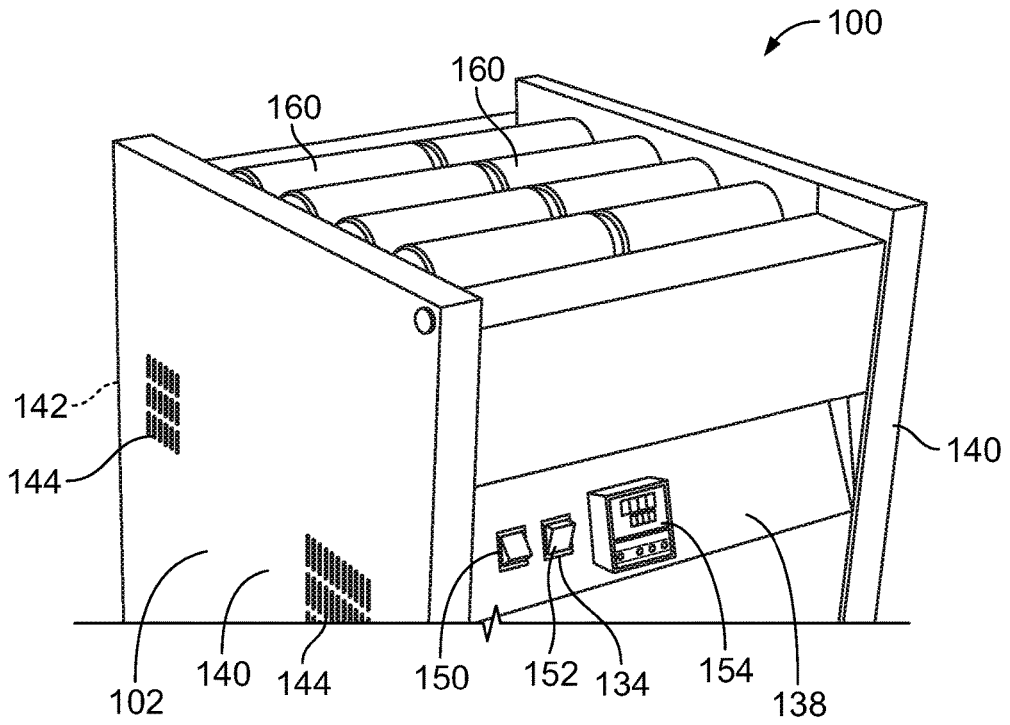
FIG. 2 illustrates a perspective front view of a beverage cooling display system, according to an embodiment of the present disclosure.
Figure 3:
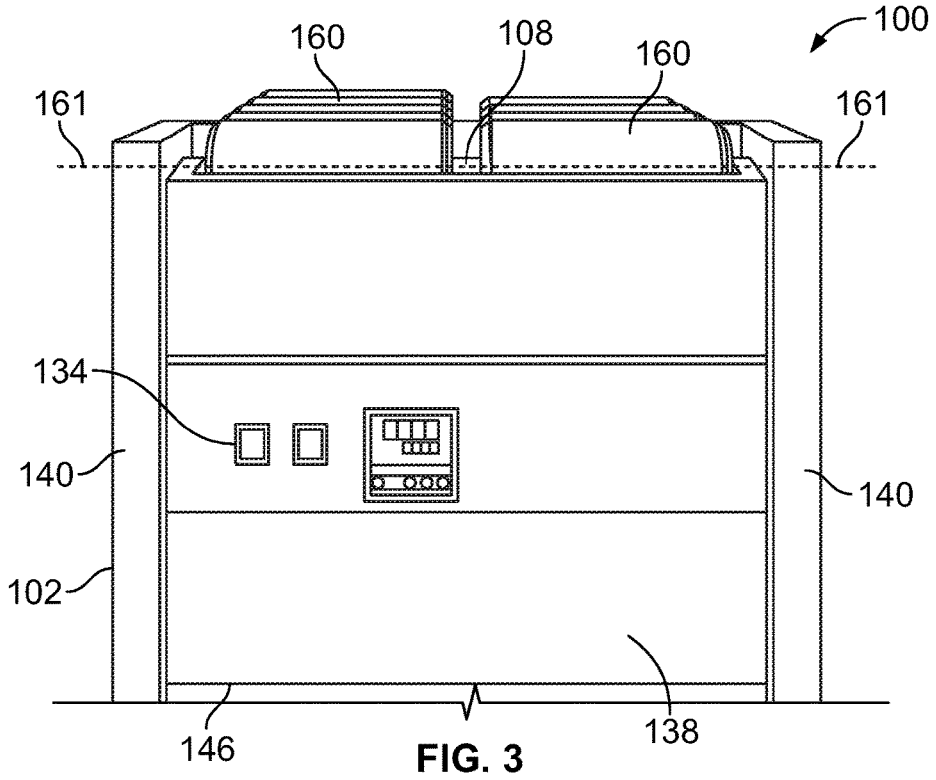
FIG. 3 illustrates a front view of a beverage cooling display system, according to an embodiment of the present disclosure.

FIG. 2 illustrates a perspective front view of the beverage cooling display system 100, according to an embodiment of the present disclosure. FIG. 3 illustrates a front view of the beverage cooling display system 100. Referring to FIGS. 2 and 3, the housing 102 may include a front panel 138 connected to side panels 140, which, in turn, connect to a rear panel 142. One or more vents 144 may be formed through the one or more of the panels 138, 140, and/or 142. A base 146 may span between the panels 138, 140, and 142 and support internal components, such as the cooling assembly 106 (shown in FIG. 1).

As shown, the user interface 134 may be positioned on the front panel 138. The user interface 134 may include a roller switch 150, a cooling switch 152, and a digital display 154. The rollers 108 may be selectively activated and deactivated through the roller switch 150. The cooling assembly 106 (shown in FIG. 1) may be selectively activated and deactivated through cooling switch 152. The digital display 154 may show a temperature of the cold plate(s) 114 (hidden from view in FIGS. 2 and 3), and may include one or more adjustment members (such as switches, buttons, keys, and/or the like) that allow an individual to adjust a temperature of the cold plate(s) 114. Alternatively, the user interface 134 may include other types of interfaces, such as a touch screen display, a keyboard, toggle switches, buttons, and/or the like.

Referring to FIGS. 1-3, beverage containers 160 are supported on the cold plates 114 and engaged by the rollers 108. As shown, each roller 108 may be longer than a beverage container 160. For example, each roller 108 may be greater than twice the length of a beverage container 160.

As such, each roller 108 may be sized to engage two separate beverage containers 160. Each cold plate 114 may be positioned underneath a row of beverage containers 160. The cold plate 114 includes an upper cradling surface that conforms to at least a portion of an outer circumferential shape of the beverage containers 160. Accordingly, the beverage containers 160 may be rotated by the rollers 108 over the cold plates 114.

The beverage cooling display system 100 may include five parallel rollers 108 and four parallel cold plates 114. As shown in FIG. 2, the rollers 108 and the cold plates 114 support eight beverage containers 160. Alternatively, more or less rollers 108 and cold plates 114 may be used to accommodate more or less beverage containers 160. For example, the beverage cooling display system 100 may include six rollers 108 and five cold plates 114 in order to accommodate ten beverage containers 160. Also, alternatively, the rollers 108 and the cold plates 114 may be shorter or longer than shown, in order to accommodate less or more beverage containers 160. For example, each roller 108 and cold plate 114 may be slightly longer than a length of a single beverage container 160.

Referring to FIGS. 1-3, each beverage container 160 may be supported between neighboring (that is, closest) rollers 108 above a cold plate 114. A portion of each beverage container 160 (such as a lower half, third, or quarter) may be suspended below the neighboring rollers 108 and rotatably supported on or otherwise above a cradling surface of the cold plate 114.

The rollers 108 are activated to rotate the beverage containers 160 above the cold plates 114. The beverage containers 160 may be rotated about their central longitudinal axes 161. For example, the beverage containers 160 may be positioned between adjacent, neighboring rollers 108 such that the longitudinal axes 161 of the beverage containers 160 are parallel with the longitudinal axes of the rollers 108. As the beverages within the beverage containers 160 are chilled by the cold plates, condensate forms on outer surfaces of the beverage containers 160. The condensate from the beverage containers 160 may fall onto the cold plates 114, thereby filling spaces between the cold plates 114 and the rotating beverage containers 160. The collected liquid condensate between the beverage containers 160 and the cold plates 114 form an efficient temperature transfer medium between the beverage containers 160 and the cold plates 114, which also forms a low friction, lubricant-like interface that minimizes or otherwise reduces the possibility of the outer surfaces of the beverage containers 160 being damaged (such as scuffed, marred, scratched, or worn) by the rollers 108 and/or the cold plates 114.

The rollers 108 may be rolled at a rate that does not substantially agitate the liquid within the beverage containers 160. That is, the rollers 108 may not roll the beverage containers 160 at a rate that would cause the internal liquid contents to pressurize to the point at which they eject out of the beverage containers 160 upon opening. In at least one embodiment, the rollers 108 may be rotated at a rate that rotates the beverage containers 160 at a rate of 1 to 2 revolutions per minute (rpm). It has been found that such a rotation rate causes the beverage containers 160 to rotate around the contained liquid, and increase a chilling rate of the liquid. Alternatively, the rotation rate may be less than 1 rpm or greater than 2 rpm.

In at least one other embodiment, the system 100 may also include separate and distinct metal (for example, aluminum) tubes, which may be filled with a cooling agent, such as glycol. Each tube may be supported on adjacent rollers 108. Adjacent tubes may then support beverage containers therein (and the tubes may be rotated by the rollers 108). The cooling agent is cooled through operation of the system 100. In this manner, different sized metal tubes may be positioned on the rollers 108. The different sized metal tubes may accommodate beverage containers of different sizes and shapes.

Figure 4:
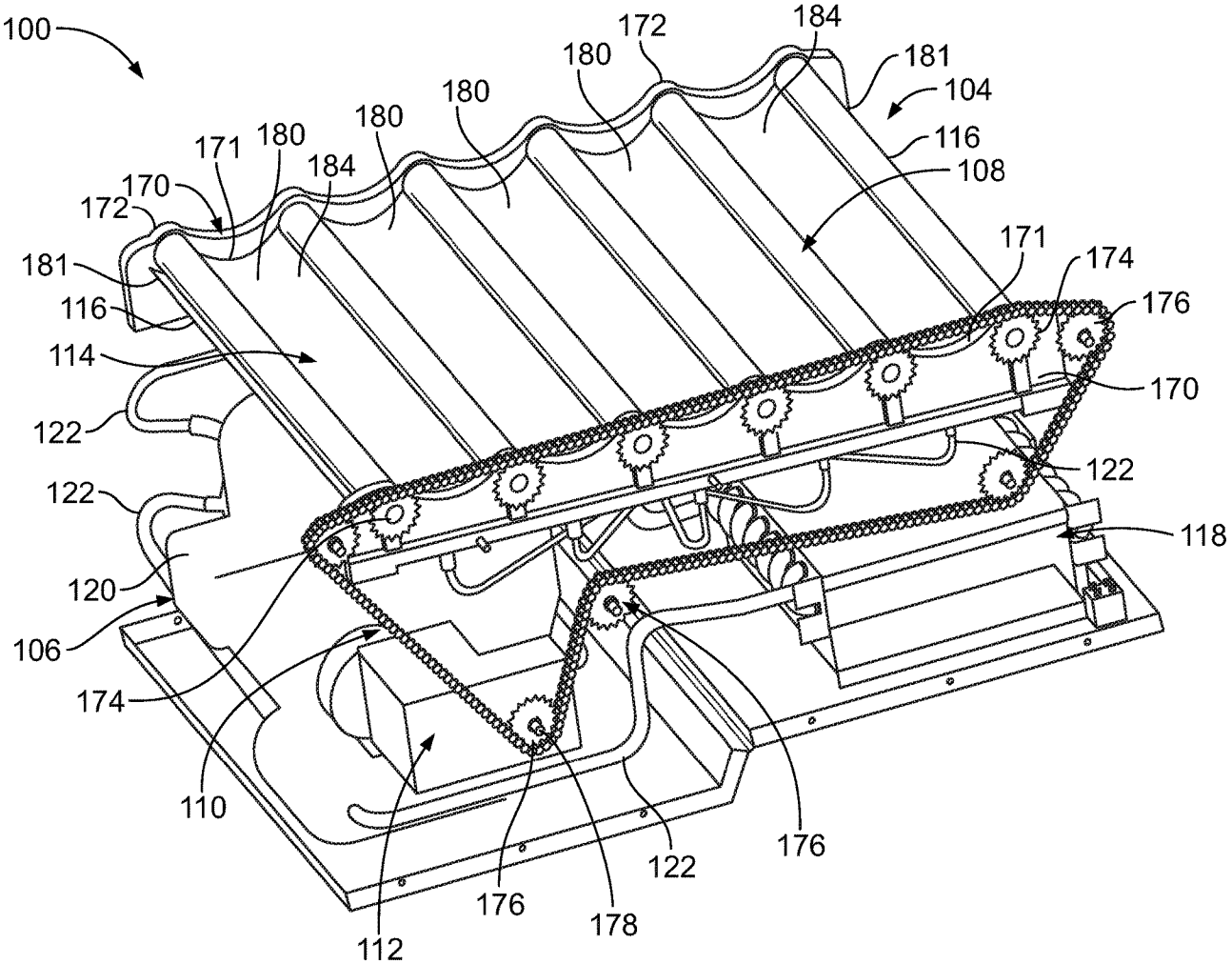
FIG. 4 illustrates a perspective internal top view of a beverage cooling display system, according to an embodiment of the present disclosure.

FIG. 4 illustrates a perspective internal top view of the beverage cooling display system 100, according to an embodiment of the present disclosure. For the sake of clarity, the housing 102 (shown in FIGS. 1-3) is not shown in FIG. 4. The cooling assembly 106 may include a plurality of cold plates 114 connected together. In at least one other embodiment, the plurality of cold plates 114 may be integrally molded and formed as a single unit, as shown in the embodiment illustrated in FIG. 10.

Opposed roller brackets 170 are positioned on opposite sides 171 of the cold plates 114. The roller brackets 170 may be connected to ends 172 of the rollers 108. For example, each roller bracket 170 may include a channel having a bearing that rotatably engages an end 172 of a roller 108.

Gears 174 may be coupled to an end 172 of each roller 108. The gears 174 operatively couple to the link 110, such as a chain. The link 110 may couple to the gears 174 and chain sprockets 176 secured within the beverage cooling display system 100. One of the sprockets 176 connects to the motor 112, such as through an axle 178. As the motor 112 rotates the axle 178, the sprockets 176 rotate, thereby causing the link 110 to rotate. As the link 110 rotates, the gears 174 connected to the rollers 108 rotate, thereby causing the rollers 108 to rotate. As the rollers 108 rotate, beverage containers supported on the cold plates 114 between the rollers 108 rotate in response thereto.

Alternatively, the rollers 108 may be rotated through various other systems and methods. For example, separate and distinct motors may be operatively connected to each roller 108. In at least one embodiment, an axle extending from a motor may be directly connected to an end of a roller 108. The motor rotates the axle to rotate the roller 108. In at least one other embodiment, a single motor may be directly coupled to one roller, which may be rotatably coupled to one or more links connected to other rollers.

Each cold plate 114 may include an upper cradling surface 180 that conforms to a shape of an outer circumference of a beverage container. For example, the upper cradling surface 180 may have a concave curvature that conforms to a portion of an outer circumferential surface of a beverage container. Therefore, as neighboring (that is, closest) rollers 108 engage a beverage container, the shape and contour of the upper cradling surface 180 supports the beverage container without substantially interfering with the rotation of the beverage container. In short, the upper cradling surface 180 may provide a bearing surface that rotatably supports the beverage container.

In at least one embodiment, the upper cradling surface 180 may not directly touch the surface of the beverage can. Instead, a gap may exist between the beverage can and the upper cradling surface 180. As the temperature of the cold plate(s) 114 drop below a dew point, condensation collects in the upper cradling surface 180. The liquid condensate fills the gap between the beverage can and the upper cradling surface 180, which increases the chilling efficiency.

Condensate collectors 116 may be positioned on a terminal end 181 of end cold plates 114. The condensate collectors 116 may provide collection troughs that are configured to collect excess condensate from the cold plates 114 and/or the beverage containers. Additional condensate collectors 116 may be positioned at junctions of neighboring cold plates 114.

As the beverage containers and the cold plates 114 are cooled, condensate may form thereon. The condensate may shed as liquid droplets that collect in the upper cradling surfaces 180. The liquid droplets in the upper cradling surfaces 180 provide a supporting, low-friction lubricant-like layer that is positioned between the upper cradling surfaces 180 and outer portions of the beverage containers. As such, the beverage containers may be supported on the cradling surfaces 180 through a thin layer of liquid, which reduces friction between the cold plates 114 and the beverage containers.

Excessive condensate may flow and collect into the condensate collectors 116. The excessive condensate may evaporate through heat generated by the motor 112, the condenser 118, and/or the compressor 120. As shown, one condensate collector 116 may be positioned directly above the compressor 120, while another condensate collector 116 may be positioned directly above the condenser 118. As such, heat generated by the compressor 120 and the condenser 118 may be directed into the condensate collectors 116, which causes liquid retained therein to evaporate. In at least one embodiment, the condensate collectors 116 may be within 5 inches or less of the compressor 120 and/or the condenser 118. As such, heat generated by the compressor 120 and/or the condenser 118 may not substantially dissipate before it reaches the condensate collectors 116, thereby effectively evaporating condensate collected in the condensate collectors 116. Alternatively, the condensate collectors 116 may be positioned a distance greater than 5 inches from the compressor 120 and/or the condenser 118. Optionally, the condensate collectors 116 may channel the excessive condensate into a drain and/or collection pan within the beverage cooling display system 100.

Figure 6:
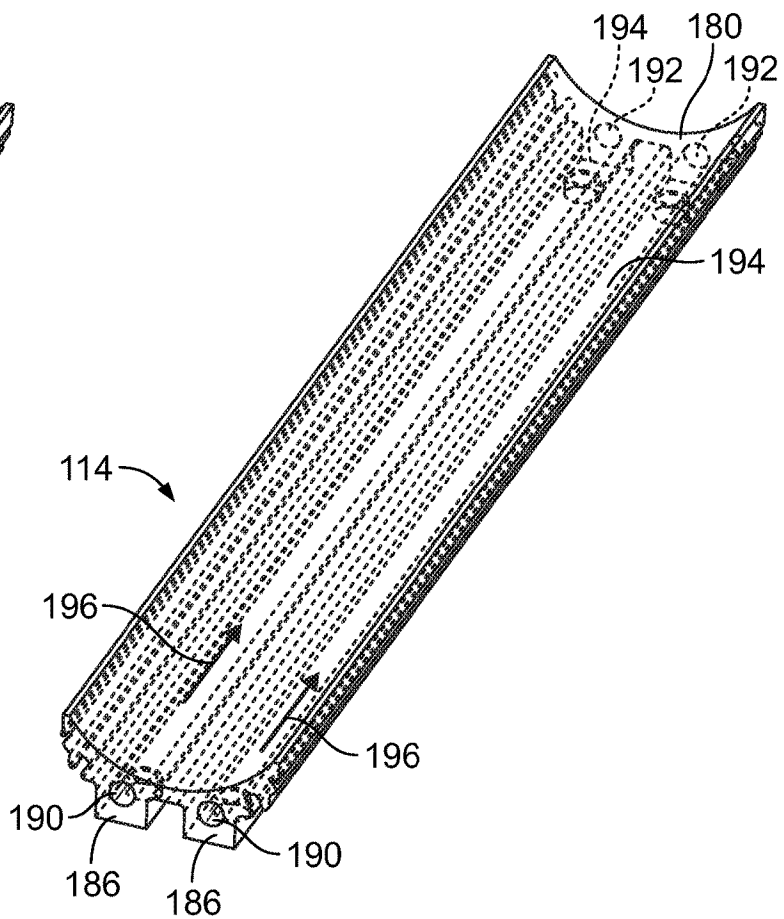
FIG. 6 illustrates a perspective top internal view of a cold plate, according to an embodiment of the present disclosure.
Figure 5:
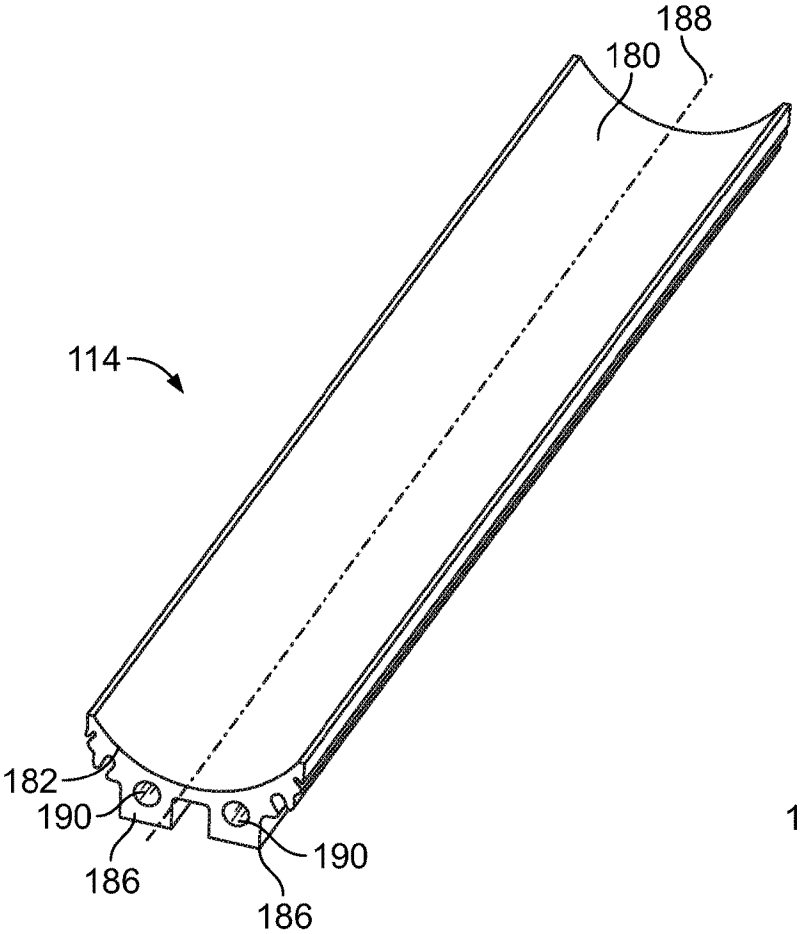
FIG. 5 illustrates a perspective top view of a cold plate, according to an embodiment of the present disclosure.

FIG. 5 illustrates a perspective top view of a cold plate 114, according to an embodiment of the present disclosure. FIG. 6 illustrates a perspective top internal view of the cold plate 114. Referring to FIGS. 5 and 6, the upper cradling surface 180 has a curvature 182 that conforms to a portion of an outer circumference of a beverage container. For example, the upper cradling surface 180 may be semi-circular and sized to conform to a portion of an outer circumference of a beverage can or bottle.

Referring to FIGS. 4-6, a retaining channel 184 is defined between the upper cradling surface 180 and inner surface of the roller brackets 170. The retaining channel 184 retains liquid droplets therein, which forms a low-friction cradling interface between the beverage containers and the upper cradling surface 180.

Refrigerant conduits 186 may be formed underneath the upper cradling surface 180. Each refrigerant conduit 186 may extend over a length of the cold plate 114 and may be parallel to a central longitudinal axis 188 of the cold plate 114. As shown, the cold plate 114 may include two parallel refrigerant conduits 186. Alternatively, the cold plate 114 may include a single refrigerant conduit 186, or more than two refrigerant conduits 186.

Each refrigerant conduit 186 may include a refrigerant inlet 190 that connects to a refrigerant outlet 192 through an internal passage 194. Cold refrigerant 196 passes into the refrigerant inlet 190 and passes through the internal passage 194 to the refrigerant outlet 192. As the cold refrigerant 196 passes through the internal passage 194, the cold refrigerant absorbs heat from the cradling surface 180, thereby lowering the temperature of the cradling surface 180, which, in turn, cools a beverage container supported on the cradling surface 180. As the refrigerant 196 passes towards the refrigerant outlet 192, the temperature of the refrigerant increases (as it has absorbed heat from the cradling surface 180), and exits the refrigerant conduit 186, where it passes to the compressor 120 by way of one or more conduits 122.

Figure 7:
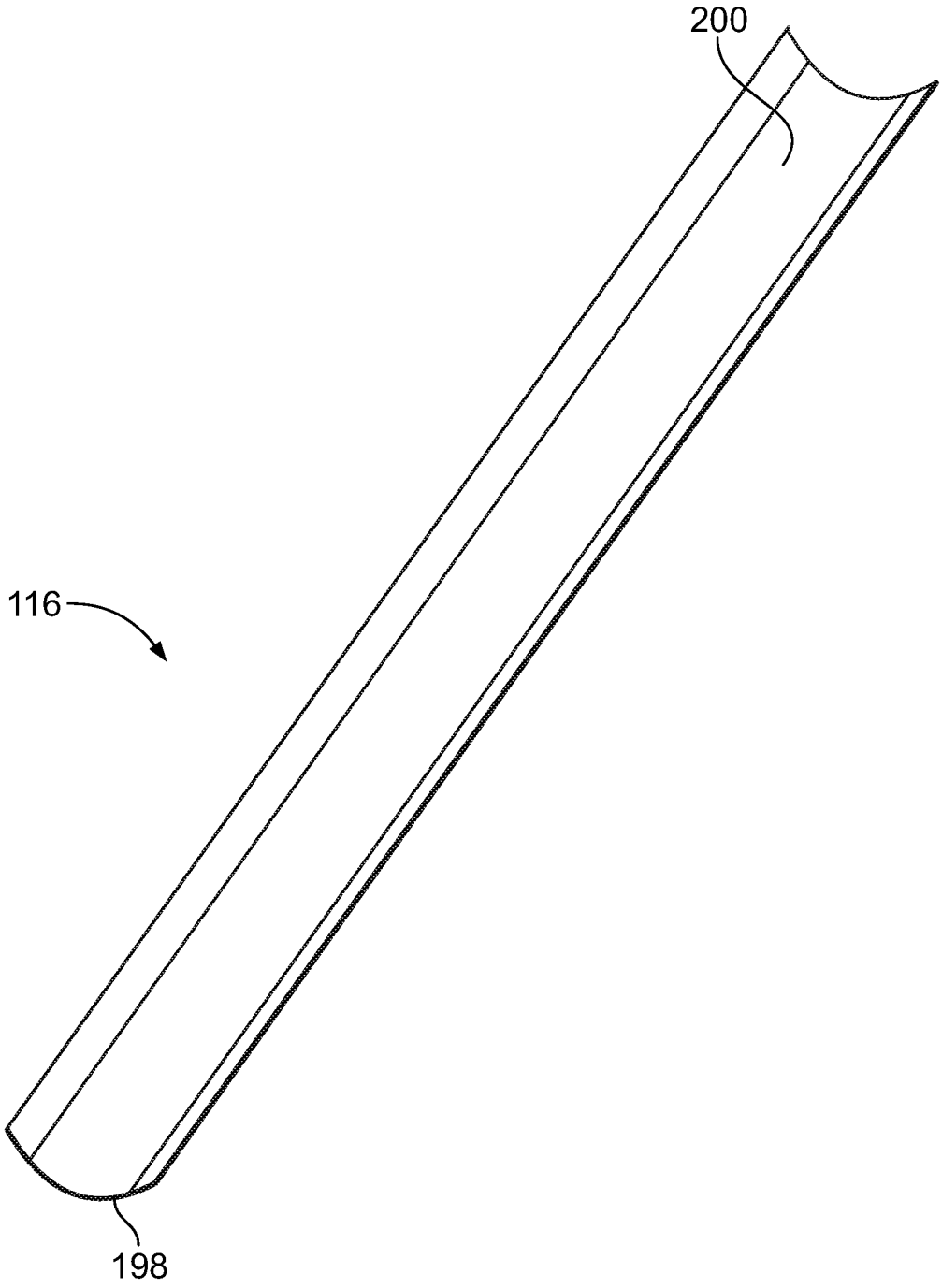
FIG. 7 illustrates a perspective top view of a condensate collector, according to an embodiment of the present disclosure.

FIG. 7 illustrates a perspective top view of a condensate collector 116, according to an embodiment of the present disclosure. The condensate collector 116 may include a semi-tubular body 198 defining an internal collection channel 200. Excess condensate collects within the collection channel 200, as described above. Referring to FIGS. 1, 4, and 7, condensate collectors 116 may be positioned at various areas of the beverage cooling display system 100, such as between adjacent cold plates 114. For example, a condensate collector 116 may be positioned underneath a roller 108 at a junction between the roller 108 and an adjacent roller 108.

Figure 8:
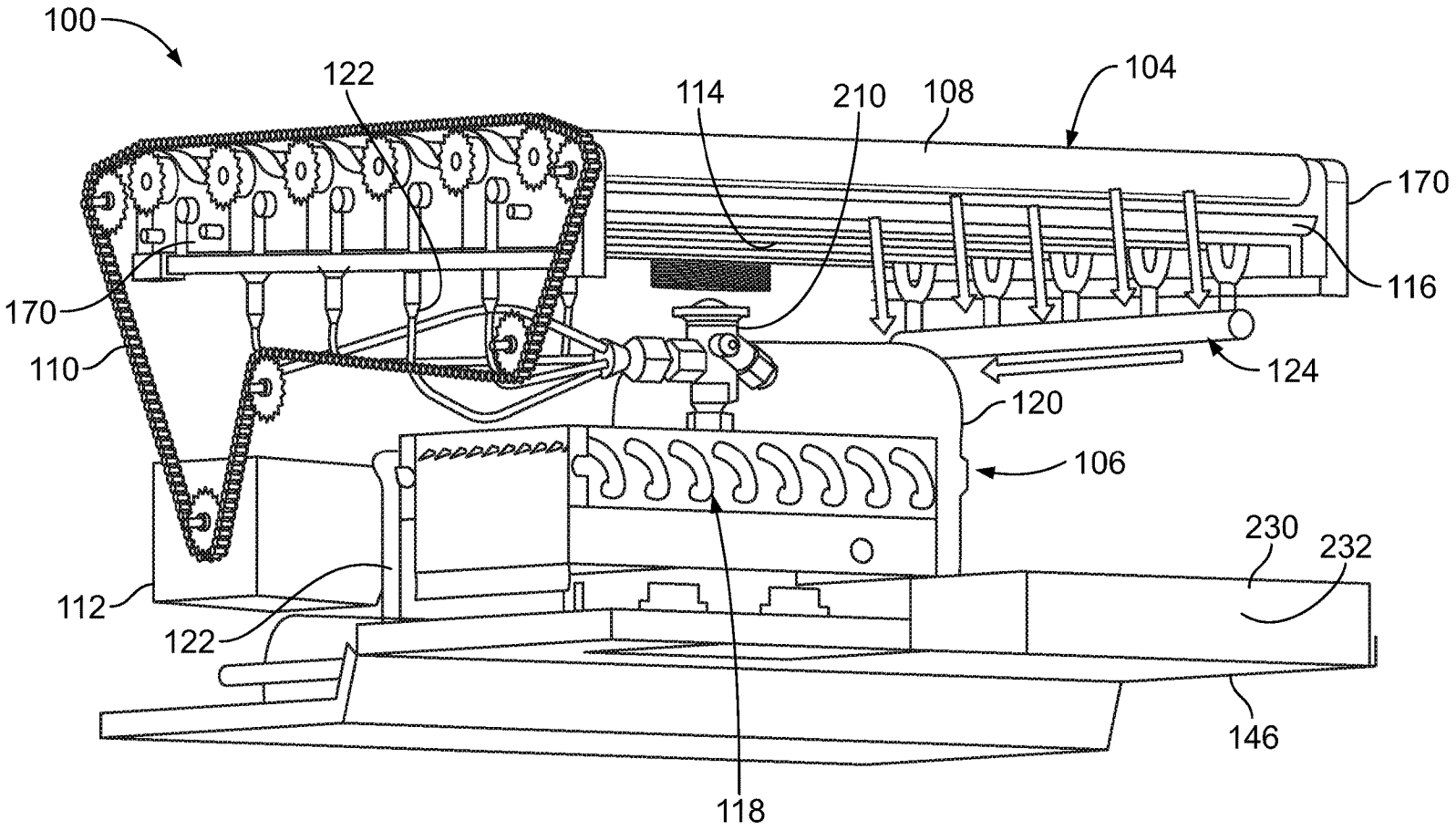
FIG. 8 illustrates a perspective internal end view of a beverage cooling display system, according to an embodiment of the present disclosure.

FIG. 8 illustrates a perspective internal end view of the beverage cooling display system 100, according to an embodiment of the present disclosure. For the sake of clarity, the housing 102 (shown in FIGS. 1-3) is not shown in FIG. 8. In order to cool the cold plates 114, the compressor 120 may regenerate the refrigerant. The compressor 120 draws gaseous refrigerant from the suction header 124 connected to the cold plates 114. The compressed refrigerant is drawn into the condenser 118 through one or more conduits 122. The condenser 118 may include a fan that facilitates movement of the refrigerant through the cooling assembly 106. The condenser 118 condenses the refrigerant into a liquid, which is then passed to a distributor 210. The distributor 210 feeds the liquid refrigerant to the cold plate 114 (for example, into the refrigerant conduits 186 shown in FIGS. 5 and 6) through conduits 122. The liquid refrigerant passes through the cold plates 114, thereby cooling the cold plates 114. As the liquid refrigerant passes through the cold plates 114, the temperature of the liquid refrigerant increases, thereby causing the refrigerant to change phase to a gas. The gaseous refrigerant 222 is drawn out of the cold plates 114 through the suction header 124 (such as through fluid flow generated by the fan of the condenser), which then passes the gaseous refrigerant 222 to the compressor 120 via one or more conduits 122, and the cycle repeats.

As shown in FIG. 8, the beverage cooling display system 100 may also include a condensate retaining tray 230, which may be supported on the base 146. The condensate retaining tray 230 may receive excess condensate that is channeled from the condensate collectors 116. For example, the condensate collectors 116 may be connected to channels formed in the cold plates 114 and/or the brackets 170 that channel the excess condensate into the condensate retaining tray 230. The excess condensate may drip down into the condensate retaining tray 230, or may pass through one or more drain tubes connected to ends of the condensate collectors 116. Excess condensate that collects in the condensate retaining tray 230 may evaporate due to the heat generated by the motor 112, the compressor 120, and/or the condenser 118. The condensate retaining tray 230 may include a handle 232 that allows an individual to remove the condensate retaining tray 230 from the housing 102 in order to dump retained condensate. Alternatively, the beverage cooling display system 100 may not include the condensate retaining tray 230.

Referring to FIGS. 1-8, the beverage containers 160 are supported on the cold plates 114 and rotated by the rollers 108. The cooling assembly 106 operates to chill the rotating beverage containers 160 to a desired temperature. The rotation of the beverage containers 160 provides an aesthetically-pleasing, eye-catching, and intriguing presentation, which may entice individuals to purchase such beverages.

Figure 9:
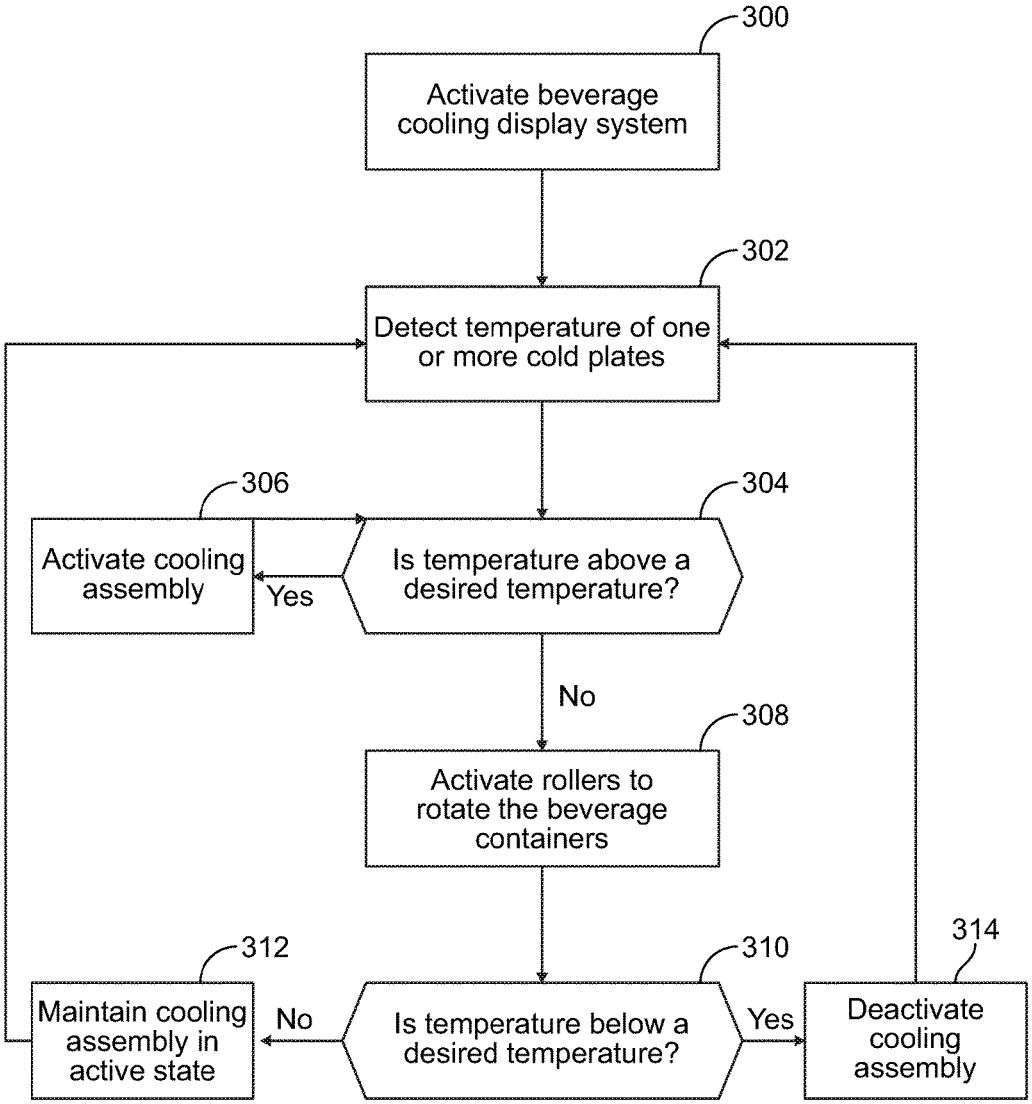
FIG. 9 illustrates a flow chart of a method of concurrently cooling and displaying a beverage, according to an embodiment of the present disclosure.

FIG. 9 illustrates a flow chart of a method of concurrently cooling and displaying a beverage, according to an embodiment of the present disclosure. The control unit 130 (shown in FIG. 1) may operate the beverage cooling display system 100 (shown in FIG. 1) according to the flow chart shown in FIG. 9. The method begins at 300, in which the beverage cooling display system is activated. For example, in response to an individual engaging an activation switch, the control unit may activate the beverage cooling system.

At 302, a temperature of one or more cold plates is detected. For example, the control unit may be in communication with one or more temperature sensors that are operatively coupled to the cold plate(s).

At 304, it is determined if the temperature of the cold plate(s) is above a desired temperature (for example, a desired temperature of 32° F.). If so, the method proceeds from 304 to 306, in which a cooling assembly is activated. The method then returns to 304 from 306.

If, however, the temperature is not above a desired temperature, but instead at or below a desired temperature, the method proceeds from 304 to 308, in which rollers are activated to rotate the beverage containers. Optionally, the rollers may be activated when the beverage cooling display is activated at 300.

At 310, it is determined if the temperature of the cold plate(s) is below a desired temperature. If not, the method proceeds from 310 to 312, in which the cooling assembly is maintained in an active cooling state. The method then returns to 302.

If, however, the temperature of the cold plate(s) is below a desired temperature, such as a temperature that may cause the contents of the beverage containers to freeze, the method proceeds from 310 to 314, in which the cooling assembly is deactivated. The method then returns to 302 from 314. Alternatively, steps 310, 312, and 314 may be omitted.

Figure 10:
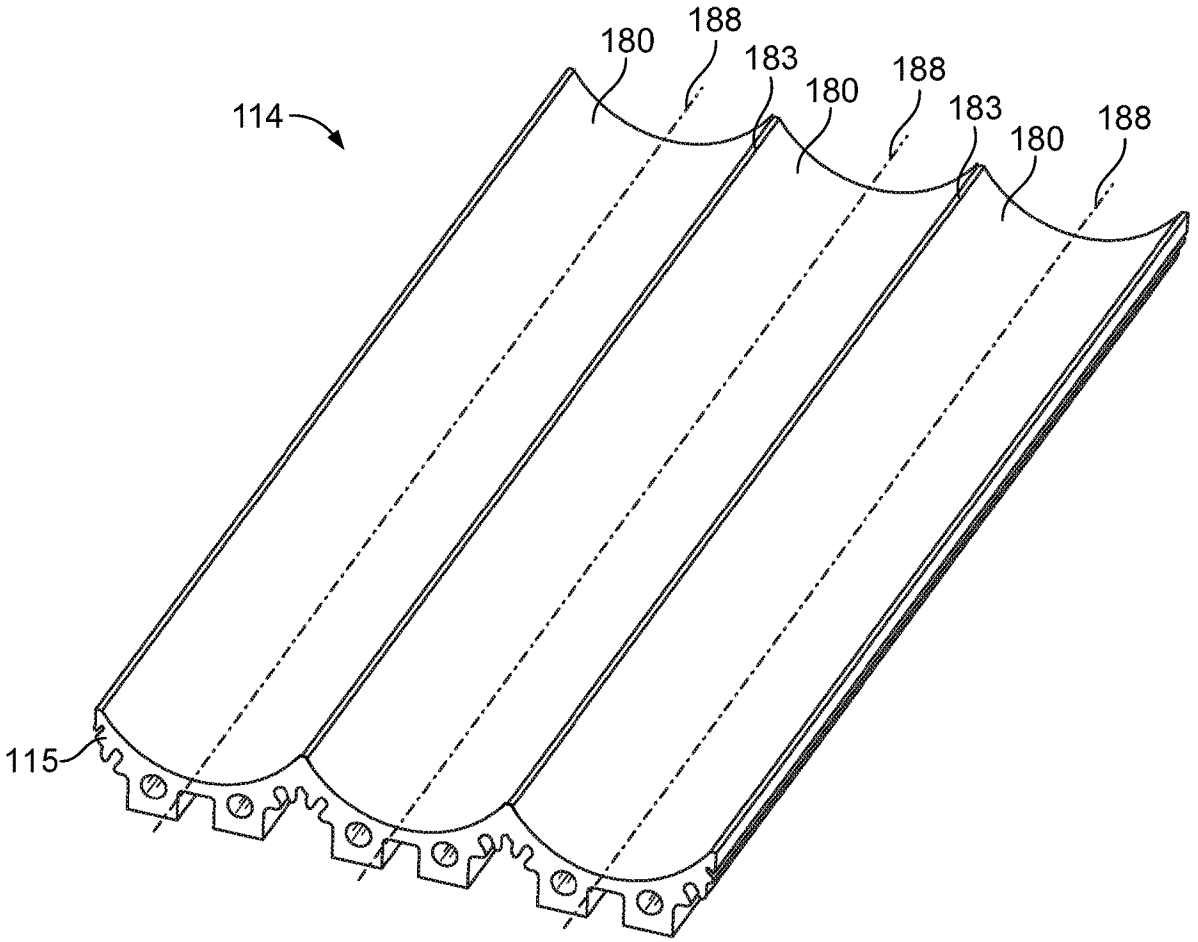
FIG. 10 illustrates a perspective top view of a cold plate, according to another embodiment of the present disclosure.

FIG. 10 illustrates a perspective top view of a cold plate 114, according to another embodiment of the present disclosure. The cold plate 114 is a single unit 115 that defines multiple upper cradling surfaces 180 and the junctions 183 between adjacent upper cradling surfaces 180. The cold plate 114 has three upper cradling surfaces 180 in the illustrated embodiment, but may have more or less than three in another embodiment. The cold plate 114 may be integrally molded or otherwise formed as the single unit 115. The cold plate 114 shown in FIG. 10 is essentially three of the individual cold plates 114 shown in FIG. 5 formed together as one. Each of the upper cradling surfaces 180 is elongated along a respective central longitudinal axis 188, and the axes 188 are parallel to one another.

Referring to FIGS. 1-10, embodiments of the present disclosure provide systems and methods for concurrently cooling and displaying beverages, such as cans or bottles of soft drinks and alcoholic drinks (such as beer, mixed drinks, and/or the like). Embodiments of the present disclosure provide systems and methods of offering cold beverages in a compact, intriguing, and eye-catching manner. Further, embodiments of the present disclosure provide systems and methods that effectively cool and display beverages.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A beverage cooling display system comprising:

a roller assembly that is configured to rotate one or more beverage containers, the roller assembly comprising multiple rollers spaced apart from one another; and a cooling assembly that is configured to cool the one or more beverage containers, wherein the cooling assembly comprises one or more cold plates, wherein the one or more beverage containers are configured to be positioned between the rollers above the one or more cold plates, and wherein the one or more cold plates comprises multiple upper cradling surfaces arranged side by side in a row with junctions between adjacent upper cradling surfaces in the row, each of the upper cradling surfaces having a concave curvature that conforms to a shape of at least a portion of an outer surface of the one or more beverage containers, each of the junctions being disposed below and aligning with a corresponding one of the rollers.

2. The beverage cooling display system of claim 1, wherein the roller assembly is configured to concurrently rotate the one or more beverage containers as the cooling assembly cools the one or more beverage containers.

3. The beverage cooling display system of claim 1, wherein the multiple rollers engage the one or more beverage containers and spin to cause the one or more beverage containers to rotate.

4. The beverage cooling display system of claim 3, wherein the rollers are operated to rotate the one or more beverage containers at a rate up to two revolutions per minute.

5. The beverage cooling display system of claim 3, wherein the roller assembly further comprises a motor and a chain that couples the motor to the rollers.

6. The beverage cooling display system of claim 1, further comprising:

a temperature sensor coupled to the one or more cold plates, wherein the temperature sensor is configured to detect a temperature of the one or more cold plates; and a control unit in communication with the temperature sensor, wherein the control unit is configured to operate the cooling assembly based on temperature signals received from the temperature sensor.

7. The beverage cooling display system of claim 6, wherein the control unit selectively activates and deactivates the cooling assembly based on a comparison of the temperature signals received from the temperature sensor and a predetermined desired temperature of the one or more cold plates.

8. The beverage cooling display system of claim 1, wherein the one or more cold plates define one or more refrigerant conduits therein underneath the upper cradling surfaces, wherein the cooling assembly further comprises:

a condenser; and a compressor, wherein the condenser and the compressor are configured to circulate refrigerant through the one or more refrigerant conduits of the one or more cold plates.

9. The beverage cooling display system of claim 1, wherein the cooling assembly comprises one or more condensate collectors that are configured to collect condensate from the one or more cold plates or the one or more beverage containers, the one or more condensate collectors comprising a trough positioned at a terminal end of the one or more cold plates or at a junction between two neighboring cold plates of the one or more cold plates.

10. The beverage cooling display system of claim 1, wherein the upper cradling surfaces are configured for collection of condensate to form a transfer medium between the one or more beverage containers and the one or more cold plates.

11. The beverage cooling display system of claim 1, wherein the upper cradling surfaces are configured for collection of condensate to form a lubricating interface between the one or more beverage containers and the one or more cold plates.

12. The beverage cooling display system of claim 1, wherein the one or more cold plates includes multiple cold plates arranged side-by-side in the row, the cold plates coupled to one another at the junctions between adjacent cold plates in the row.

13. The beverage cooling display system of claim 1, wherein each of the one or more cold plates defines at least one refrigerant conduit therein that is underneath the upper cradling surfaces, the at least one refrigerant conduit configured to receive a refrigerant therethrough to absorb heat from the upper cradling surfaces.

14. The beverage cooling display system of claim 1, wherein the one or more cold plates is a single, integrally molded unit that defines the multiple upper cradling surfaces and the junctions therebetween.

15. The beverage cooling display system of claim 1, wherein the multiple rollers are elongated and parallel to one another and each pair of adjacent rollers is configured to engage and support a corresponding one beverage container of the one or more beverage containers between the pair of adjacent rollers such that the corresponding one beverage container is suspended above a corresponding cold plate of the one or more cold plates without directly touching the corresponding upper cradling surface of the corresponding cold plate located below the corresponding one beverage container.

16. A method of cooling and displaying beverages, the method comprising:

rotating one or more beverage containers with a roller assembly, the roller assembly comprising multiple rollers spaced apart from one another; and cooling the one or more beverage containers with a cooling assembly, wherein the cooling assembly includes multiple cold plates arranged side by side in a row with junctions between adjacent cold plates in the row, the cold plates positioned below the rollers and the one or more beverage containers disposed between the rollers, each of the cold plates including an upper cradling surface having a concave curvature that at least partially complements an outer surface of the one or more beverage containers, wherein each of the junctions is disposed below and aligns with a corresponding one of the rollers.

17. The method of claim 16, wherein the rotating is concurrent with the cooling.

18. The method of claim 16, wherein the rotating comprises operating the rollers to cause the one or more beverage containers to rotate.

19. The method of claim 18, wherein the operating comprises rotating the one or more beverage containers at a rate up to two revolutions per minute.

20. The method of claim 16, further comprising:

detecting a temperature of at least a portion of the cooling assembly; and using a control unit to automatically operate the cooling assembly based on temperature signals received from a temperature sensor.

21. The method of claim 20, wherein the using comprises selectively activating and deactivating the cooling assembly based on a comparison of the temperature signals received from the temperature sensor and a predetermined desired temperature of the cold plates.

22. The method of claim 16, further comprising collecting condensate from the cold plates or the one or more beverage containers with one or more condensate collectors.

23. A beverage cooling display system comprising:

a roller assembly that is configured to rotate beverage containers, wherein the roller assembly comprises: (a) rollers that are configured to cause the beverage containers to rotate, wherein the rollers are operated to rotate the beverage containers at a rate up to two revolutions per minute, (b) at least one motor coupled to the rollers, and (c) a link that couples the at least one motor to the rollers;

a cooling assembly that is configured to cool the beverage containers, wherein the cooling assembly comprises: (a) cold plates, wherein each of the beverage containers is configured to be positioned above one of the cold plates, wherein each of the cold plates includes an upper cradling surface having a concave curvature that conforms to a shape of at least a portion of an outer surface of the beverage containers, (b) a condenser, (c) a compressor, wherein the condenser and the compressor are configured to circulate refrigerant through the cold plates, and (d) condensate collectors that are configured to collect condensate from the cold plates or the beverage containers;

a temperature sensor coupled to the cold plates, wherein the temperature sensor is configured to detect a temperature of the cold plates; and a control unit in communication with the temperature sensor, wherein the control unit is configured to operate the cooling assembly based on temperature signals received from the temperature sensor, wherein the control unit selectively activates and deactivates the cooling assembly based on a comparison of the temperature signals received from the temperature sensor and a predetermined desired temperature of the cold plates.

* * * * *